US005631211A

United States Patent [19]

Nakagawa et al.

[11] Patent Number: 5,631,211

[45] Date of Patent: May 20, 1997

[54] LUBRICATING OIL COMPOSITION FOR USE WITH SINTERED POROUS BEARINGS

[75] Inventors: Hisaya Nakagawa; Michiaki Takizawa; Teruhiko Ohtaki, all of Nagano; Katsumi Nagano, Aichi; Masuhiro Onoyama, Aichi; Tetsuo Ichimaru, Aichi, all of Japan

[73] Assignee: Kabushiki Kaisha Sankyo Seiki Seisakusho, Nagano, Japan

[21] Appl. No.: 334,317

[22] Filed: Nov. 1, 1994

[30] Foreign Application Priority Data

Nov. 1, 1993 [JP] Japan ..... 5-293867

[51] Int. Cl.[6] ..... C10M 107/02

[52] U.S. Cl. ..... 508/108; 508/371; 508/379; 508/591; 585/10; 585/12

[58] Field of Search ..... 252/32.7 E; 585/10, 585/12; 508/108, 591

[56] References Cited

U.S. PATENT DOCUMENTS

| | | | |
|---|---|---|---|
| 3,965,018 | 6/1976 | Heilman et al. | 585/10 |
| 4,417,082 | 11/1983 | Larkin et al. | 585/12 |
| 4,420,646 | 12/1983 | Darden et al. | 585/12 |
| 4,537,696 | 8/1985 | Beimesch | 585/10 |
| 4,956,122 | 9/1990 | Watts et al. | 585/12 |
| 4,992,183 | 2/1991 | Beimesch et al. | 252/32.7 E |
| 5,015,404 | 5/1991 | Kubo et al. | 252/50 |
| 5,089,156 | 2/1992 | Chrisope et al. | 585/12 |
| 5,171,908 | 12/1992 | Rudnick | 585/10 |
| 5,382,739 | 1/1995 | Atkins et al. | 585/12 |

*Primary Examiner*—Ellen M. McAvoy

*Attorney, Agent, or Firm*—Sughrue, Mion, Zinn, Macpeak & Seas

[57] ABSTRACT

Lubricating oil composition for use with sintered porous bearings includes a poly-α-olefin hydride or ethylene-α-olefin copolymer hydride containing base oil to which at least one additive selected from the group consisting of zinc dialkyl dithiophosphate, molybdenum dialkyl dithiocarbide, molybdenum dialkyl dithiophosphate and a sulfur-phosphorus containing extreme pressure additive is added in an amount of 0.01 to 5 parts by weight per 100 parts by weight of the base oil.

18 Claims, 3 Drawing Sheets

LUBRICATING OIL COMPOSITION FOR USE WITH SINTERED POROUS BEARINGS

BACKGROUND OF THE INVENTION

1. Field of the Invention

The present invention relates to lubricating oil compositions for use with bearing assemblies that use sintered porous bearings. More particularly, the invention relates to lubricating oils suitable for impregnation in sintered porous bearings that are typically used in small motors, etc.

2. Related Art

Sintered, oil-filled bearings for use in high-speed and light-load applications have the advantage that they can be operated without additional oil supplies during service. Because of this feature, sintered, oil-filled bearings are extensively used in bearing assemblies for a variety of small motors such as motors to rotationally drive magnetic disks and motors to operates audio-related instruments and various other machines and equipment.

With the recent advances in the performance of the machines and equipment with which the sintered, oil-filled bearings are used, increasingly high and versatile performance has been required of those bearings and this has given rise to the need for a sophisticated lubrication technology.

There have been two approaches in the improvement of bearings, one by improving the properties of the metals to be sintered and the other by improving the lubricating oils to be impregnated in the sintered metals.

The increasing tendency in the art is putting emphasis on the characteristics of lubricating oils. This is chiefly attributable to the mechanism of lubrication in sintered, oil-filler bearings; although lubricated with oils, these bearings do not operate by fluid-film lubrication but are used in a state that is close to boundary lubrication; therefore, the performance of the bearings will depend largely upon the characteristics of the lubricating oils with which they are filled.

The lubricating oils for use with sintered porous bearings are generally required to have the following characteristics:

(1) permit low current values (hence, small power consumption);

(2) will shortly "break in" and undergo no changes;

(3) can be used form low to high temperatures (−40° to 120° C.);

(4) can withstand high speeds (about 30,000 rpm); and (5) can withstand low speeds (about 50 to 180 rpm).

The lubricating oils conventionally used with sintered porous bearings are based on various paraffinic and naphthenic mineral oils, as well as ester-based, polyolefinic and various other synthetic oils and these lubricating oils are used in diverse applications as appropriate to their specific characteristics.

A typical example of small motors that use a sintered, oil-filled bearing and that have a bearing holder will now be described with reference to FIG. 1. As shown, a substrate 10 is overlaid with a spacer 12 and a stator core 14. The stator core 14 has a central hole into which a bearing holder 16 is partly fitted and a flange portion 18 molded integrally with the bearing holder 16 is placed on top of the stator 14. A screw penetrating the flange portion 18, stator core 14 and spacer 12 is threaded into the substrate 10, whereby the bearing holder 16, stator core 14 and spacer 12 are fixed to the substrate 10. The stator core 14 has a plurality of salient poles and a drive coil 15 is wound around each salient pole.

Two sintered, oil-filled bearings 22 are pressed against the inner periphery of the bearing holder 16. The sintered, oil-filled bearings 22 compose a radial bearing unit that rotatably supports a shaft 24 inserted through the center of the motor so that it contacts the inner periphery of each bearing 22. As shown, the lower end of the shaft 24 contacts a thrust receptacle 26 filled in a hole in the substrate 10 and the thrust load to be exerted on the shaft 24 will be carried by the receptacle 48. A rotor 28 is coupled to the upper end of the shaft 24 which projects above the upper bearing 22. An annular drive magnet 25 is secured to the rotor 28 and the inner peripheral surface of the magnet 25 is opposite to, but spaced from, the outer peripheral surfaces of the salient poles of the stator core 14.

The rotor 28 and the shaft 24 which is integral with it are rotationally driven by successive on-off control on the supply of an electric current to the drive coils 15 in accordance with the rotating position of the drive magnet 25. The sintered, oil-filled bearings 22 have a very large number of micropores (not shown) which are filled with a conventional lubricating oil. As the shaft 24 rotates, the conventional lubricating oil oozes from the sintered, oil-filled bearings 22 and lubricates the surface of the shaft 24 as it slides against the bearings 22.

As already described hereinabove, the conventional lubricating oils for impregnation in sintered porous bearings have been based on paraffinic or naphthenic mineral oils, as well as ester-based, polyolefinic and various other synthetic oils and these lubricating oils are used as appropriate to their characteristics. No lubricating oils are used exclusively with sintered porous bearings and, instead, suitable types are selected from among commercial hydraulic working oils, engine oils, etc. (see "Gekkan Toraiboroji (Monthly Tribology)", February 1992, p. 60.)

Conventional common lubricating oils have oxidation inhibitors, rust inhibitors, foam inhibitors and metal inactivators added to base oils. In certain cases, other additives are incorporated such as detergent-dispersants, viscosity-index improvers and pour-point depressants.

Lubricating oils based on mineral oils have additional problems in that the paraffin content crystallizes as wax under low temperature to permit the passage of a larger current and that impurities or the products of their reaction with additives will crystallize to form sludge deposits that promote the wear of the rotating shaft and permit the passage of a greater current.

SUMMARY OF THE INVENTION

An object, therefore, of the present invention is to provide a lubricating oil that will generate less sludge during service, that can be used over a broad temperature range, that exhibits satisfactory lubricating properties and that is suitable for use with sintered porous bearings intended for long-term service.

Another object of the invention is to provide a lubricating oil for use with a bearing assembly that adopts a sintered porous bearing mounted in a small motor, which lubricating oil will not readily flow out of the bearing assembly and, hence, will contribute to substantial improvement in the various characteristics thereof.

As an aspect of the present invention, there is provided a lubricating oil composition for use with sintered porous bearings comprising a base oil containing one of a poly-α-olefin hydride and ethylene-α-olefin copolymer hydride; and at least one additive selected from the group consisting of zinc dialkyl dithiophosphate, molybdenum dialkyl dithiocarbide, molybdenum dialkyl dithiophosphate and a sulfur-phosphorous containing extreme pressure additive added in an amount of 0.01 to 5 parts by weight per 100 parts by weight of the base oil.

According to the present invention, the base oils containing the poly-α-olefin hydride and/or the ethylene-α-olefin copolymer hydride could provide lubricating oils that were satisfactory in various aspects including not only initial "run-in" characteristics, high-temperature life and low-temperature characteristics, but also wear resistance and protection against overcurrent.

According to the present invention, the lubricating oil with the polyethylene thusly incorporated in the base oil containing the poly-α-olefin hydride or the ethylene-α-olefin copolymer hydride is impregnated in a sintered porous bearing, the lubricating oil will not readily flow out of the bearing. Therefore, this sintered, oil-filled bearing can advantageously be used as part of the bearing assembly for small motors or the like without experiencing any deterioration in its characteristics such as the passage of an increased amount of current through the motor, increases vibrations of the rotating shaft and increased wow flutters because less of the lubricating oil will flow out of the gap between the shaft and the thrust receptacle and from the gap between the bearing and the mating member.

According to the present invention, the lubricating oil for use with a bearing assembly of the invention has a polyethylene added in an amount of 0.5 to 10 parts by weight to 100 parts by weight of the base oil containing the poly-α-olefin hydride or the ethylene-α-olefin copolymer hydride. If this lubricating oil is impregnated in a sintered porous bearing, it will not readily flow out of the latter during service and, hence, the bearing can advantageously be applied to small motors of the like with desirable improvement in their characteristics as exemplified by a smaller current flowing through the motor, less vibrations of the rotating shaft and reduced wow flutters.

DETAILED DESCRIPTION OF THE PREFERRED EMBODIMENTS

Figure 1:
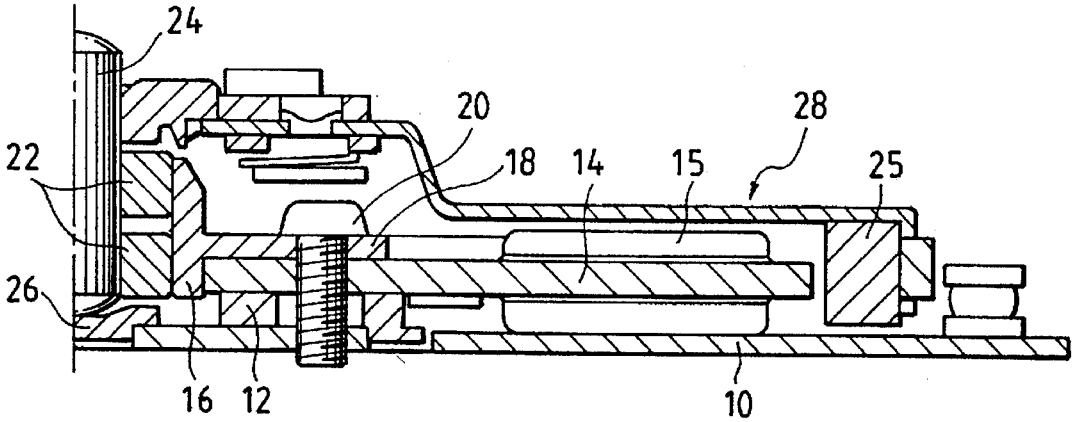
FIG. 1 is a longitudinal section of a motor that has a bearing holder and that uses a sintered, oil-filled bearing.

A example of the lubricating oil for use with a bearing assembly that adopts a sintered porous bearing in accordance with the invention is described below.

First, it should be noted that the base oil for the lubricating oil of the present invention contains a poly-α-olefin hydride or an ethylene-α-olefin copolymer hydride. Stated more specifically, the lubricating oil of the invention is a composition that comprises a poly-α-olefin hydride or ethylene-α-olefin copolymer hydride containing base oil to which at least one additive selected from the group consisting of zinc dialkyl dithiophosphate, molybdenum dialkyl dithiocarbide, molybdenum dialkyl dithiophosphate and a sulfur-phosphorus containing extreme pressure additive is added in an amount of 0.01 to 5 parts by weight per 100 parts by weight of the base oil. Preferably, the total of the poly-α-olefin hydride or the ethylene-α-olefin copolymer hydride accounts for at least 50 wt % of the base oil.

The poly-α-olefin hydride may typically be prepared by hydrogenating the product of polymerization of 1-decene, isobutene, etc. in the presence of a catalyst such as a Lewis acid. The ethylene-α-olefin copolymer hydride may typically be prepared by hydrogenating the product of copolymerization of ethylene with 1-decene, isobutene, etc. in the presence of a catalyst such as a Lewis acid. These polymer hydrides have preferably number average molecular weights of from about 200 to about 1,600. The hydrogenation need not be performed to 100% but it should be remembered that lower degrees of hydrogenation increases the chance for deterioration.

Even if they are incorporated in small amounts, the poly-α-olefin hydride and the ethylene-α-olefin copolymer hydride will exhibit satisfactory wear resistance without sludge formation, thereby insuring high endurance. Further, they permit the passage of only small current and shorten the time of initial "run-in" or the time required for "breaking in" the lubricating oil. Hence, the poly-α-olefin hydride and the ethylene-α-olefin copolymer hydride have the advantage that satisfactory wear resistance is assured even if conventional antiwear agents and/or extreme pressure additives are incorporated in very small amounts.

As already mentioned, the base oil used in the present invention contains the poly-α-olefin hydride or the ethylene-α-olefin copolymer hydride but it is preferably the poly-α-olefin hydride or the ethylene-α-olefin copolymer hydride or a mixture thereof. More preferably, the base oil is composed of a mixture of the poly-α-olefin hydride and the ethylene-α-olefin copolymer hydride. In this preferred case, 100 parts by weight of the poly-α-olefin hydride may be mixed with 10 to 350 parts by weight, preferably 50 to 200 parts by weight, of the ethylene-α-olefin copolymer hydride.

Another preferred base oil is such that a polymethacrylate or a polybutene is incorporated in the poly-α-olefin hydride or the ethylene-α-olefin copolymer hydride or a mixture thereof. Preferred polymethacrylate have number average molecular weights of 5,000 to 100,000 whereas preferred polybutenes have number average molecular weights of 300 to 50,000. The polybutene may assume the form of poly-1-butene, poly-2-butene, polyisobutene or a mixture thereof. The polymethacrylate or polybutene may be incorporated in an amount of 5 to 200 parts by weight, preferably 10 to 100 parts by weight, per 100 parts by weight of the poly-α-olefin hydride, the ethylene-α-olefin copolymer hydride or a mixture thereof. The polymethacrylate or polybutene will also serve as a thickener.

The lubricating oil of the present invention is a composition that comprises the above-described base oil to which at least one additive selected from the group of consisting of zinc dialkyl dithiophosphate, molybdenum dialkyl dithiocarbide, molybdenum dialkyl dithiophosphate and a sulfur-phosphorus containing extreme pressure additive is added in an amount of 0.01 to 5 parts by weight per 100 parts by weight of the base oil. The zinc dialkyl dithiophosphate, molybdenum dialkyl dithiocarbide and molybdenum dialkyl dithiophosphate may be obtained from commercial sources and they may be used in amounts ranging generally from 0.01 to 5 parts by weight, preferably from 0.01 to 1 part by weight, per 100 parts by weight of the base oil. The sulfur-phosphorus containing extreme pressure additive is a mixture sulfur-containing additive selected from among sulfurized fats or oils, sulfurized terpenes, sulfurized olefines, various sulfides, etc. with a phosphorus-containing extreme pressure additive selected from among phosphites, phosphates, amine phosphates, etc.; this is commercially available under the trade name "Lubrizol 5034A" from Nippon Lubazol Co., Ltd.

It should be noted that for the purposes of the invention, the zinc dialkyl dithiophosphate, molybdenum dialkyl dithiocarbide and molybdenum dialkyl dithiophosphate are not classified as "sulfur-phosphorus containing extreme pressure additive" even if they contain phosphorus or sulfur.

The sulfur-phosphorus containing extreme pressure additive is used in an amount of 0.01 to 5 parts by weight, preferably 0.1 to 2 parts by weight, per 100 parts by weight of the base oil.

The additives to be incorporated in the base oil in accordance with the invention will exhibit satisfactory anti-wear effect even if only one kind of such additives is used. However, better anti-wear effect will be exhibited by using two or more additives selected from among the zinc dialkyl dithiophosphate, molybdenum dialkyl dithiocarbide and molybdenum dialkyl dithiophosphate.

The base oil composition for the lubricating oil of the invention may further contain foam inhibitors, rust inhibitors, oxidation inhibitors and other additives that are commonly incorporated in lubricating oils.

The lubricating oil of the invention is used after it is impregnated in various sintered metallic materials of which sintered, oil-filled bearings are made. The impregnated bearings can be used in various applications and particularly good results are attained if they are used as bearings for video tape recorders.

Figure 2:
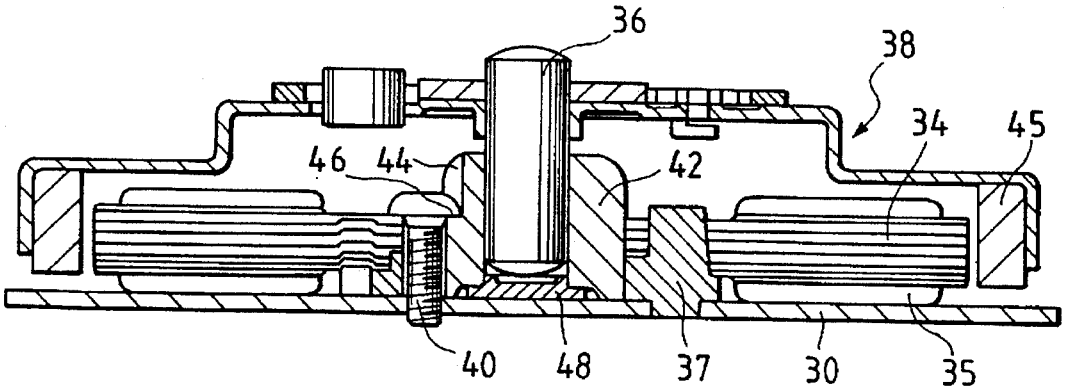
FIG. 2 is a longitudinal section of a motor that uses a sintered, oil-filled bearing but which does not use a bearing holder.
Figure 3:
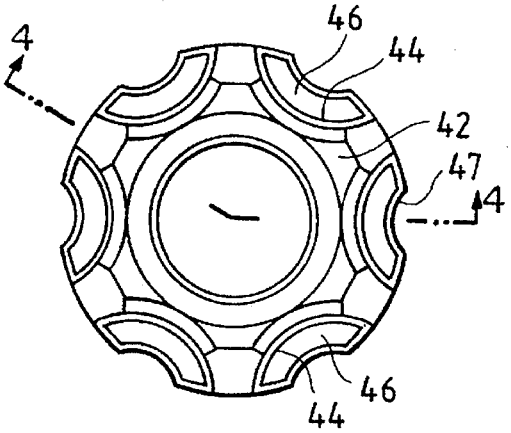
FIG. 3 is a plan view of the sintered, oil-filled bearing that is used in the motor shown in FIG. 2.
Figure 4:
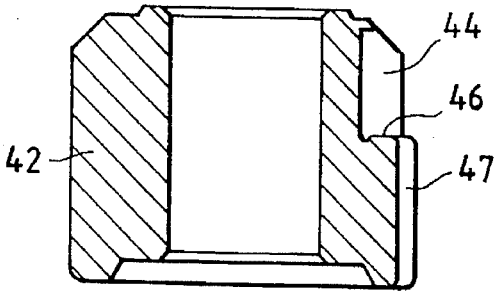
FIG. 4 is a cross section taken on line 4—4 of FIG. 3.

At the recent time, to reduce the number of parts or components of the motor, one may retain the bearings without using the bearing holder as shown in FIGS. 2 to 4 (although this idea is yet to be known in the art). As shown in FIGS. 2 to 4, a substrate 30 is overlaid with a spacer 37 and a stator core 34. The stator core 34 and the spacer 37 have central holes, into which a single sintered, oil-filler bearing 42 is fitted.

FIGS. 3 and 4 show one example of a motor structure applied to a lubricating oil of the present invention.

The sintered, oil-filled bearing 42 is generally cylindrical in shape and has a certain length in the axial direction and a plurality of partly cylindrical cutouts 44 and 47 are formed equidistantly on the outer periphery of the bearing 42. The cutouts 47 are continuous to the cutouts 44 but the latter have a greater depth of radial cut than the former, whereby a step 46 is formed between each cutout 44 and the cutout 47 continuous to it. As shown clearly in FIG. 4, the cutouts 44 are formed in the upper half of the sintered, oil-filled bearing 42 whereas the cutouts 47 are formed in its lower half.

As shown in FIG. 2, a screw 40 is provided along each of the cutouts 47 in the sintered, oil-filled bearing 42 and threaded into the substrate 30. The heads of the screws 40 are located within the cutouts 44 in the sintered, oil-filled bearing 42 and the jaw at the boundary between the shank of each screw 40 and its head will hold down the step 46 in the bearing 42, whereby the latter is fixed on the substrate 30.

The jaw of each screw 40 also holds down the edge portion of the central hole in the stator core 34, whereby the latter is also fixed on the substrate 30 with the spacer 37 being interposed. The stator core 34 has a plurality of salient poles and a drive coil 35 is wound around each salient pole.

The sintered, oil-filled bearing 42 provides a radial bearing that rotatably supports a shaft 36 inserted through the center of the motor so that it contacts the inner periphery of the bearing 42. As shown, the lower end of the shaft 36 contacts a thrust receptacle 48 urged against the substrate 30 by the bearing 42 and the thrust load to b exerted on the shaft 36 will be carried by the receptacle 48. A rotor 38 is coupled to the upper end of the shaft 36 which projects above the bearing 42. An annular drive magnet 45 is secured to the rotor 38 and the inner peripheral surface of the magnet 45 is opposite to, but spaced from, the outer peripheral surfaces of the salient poles of the stator core 34.

The rotor 38 and the shaft 36 are rotationally driven by successive on-off control on the supply of an electric current to the drive coils 35 in accordance with the rotating position of the drive magnet 45. The sintered, oil-filled bearing 42 is also filled with a conventional lubricating oil, which will lubricate the surface of the shaft 36 as it slides against the bearing 42.

If the conventional lubricating oils are used with motors having no bearing holder as shown in FIGS. 2 to 4, new problems have been found to occur. That is, the outer peripheral surface of the sintered, oil-filled bearing 42 is in direct contact with the inner peripheral surfaces of the stator core 34 and the spacer 32 whereas the bottom of the bearing 42 is in direct contact with the substrate 30 and, hence, the conventional lubricating oil impregnated in the bearing 42 will flow out of the gap between its outer periphery and the inner peripheries of the stator core 34 and the spacer 32, from the gap between the bottom of the bearing 42 and the substrate 30, and even form the gap between the shaft 36 and the thrust receptacle 48. As a result, the lubricating oil in the bearing 42 is depleted to cause various cases of characteristic deterioration such as the passage of a greater current through the motor, increased shaft vibrations and increased wow flutter.

First Embodiment

Examples of the present invention as it relates chiefly to the base oil will now be described below. In the following examples, all compositional proportions are on a weight basis.

Examples 1 to 8 and Comparative Examples 1 and 2

Using the base oils listed in Table 1, lubricant oils or oil compositions for use with a sintered porous bearing were prepared according to the formulations listed in Table 2 (Examples 1 to 8 and Comparative Examples 1 and 2). A testing apparatus was set up by first installing a shaft through a motor adapted in rotational speed to a video tape recorder and then fitting the shaft with sintered bearings that were impregnated with the respective lubricating oils. With a lateral pressure of 2.8 kg being applied to this test apparatus, the performance of these lubricating oils was evaluated by measuring the current flowing through the motor. The test conducted were: an aging test for investigating the initial "run-in" characteristics at room temperature; a cold test for examining the current characteristics at −10° C.; and a hot test for checking the life characteristics at 60° C. The testing conditions were as follows: the motor rotating speed was 60 rpm for the aging and hot tests, and 900 rpm for the cold test;

the test period was 1 h for the aging test, and 100 h for the cold and hot tests. In the aging test, the time required for the current to reach just short of 50 mA was measured; in the cold and hot tests, the current flowing after the lapse of 100 h was measured.

The test results are shown in Table 2.

TABLE 1

| | Mol. wt. | Base oil 1 | 2 | 3 | 4 | 5 |
|---|---|---|---|---|---|---|
| PAO | 200 | 40 | — | — | — | — |
| PAO | 600 | 40 | 51 | 65 | 75 | — |
| PEAO | 1,450 | 60 | 49 | — | — | — |
| PMA | 40,000 | — | — | 35 | — | — |
| PB | 40,000 | — | — | — | 25 | — |
| Viscosity, cst at 40° C. | | 200 | 200 | 200 | 200 | 100 |

Notes:
PAO, polyolefin (Synflube 201, 601 of Chevron Corporation)
PEAO, polyethylene-α-olefin copolymer (Lucant 100 of Mitsui Petrochemical Industries, Ltd.)
PMA, polymethacrylate (Aklube 702, 707 of Sanyo Chemical Industries, Ltd.)
PB, polybutene (Tetrat of Nippon Petrochemicals Co., Ltd.)
Base oil 5, commercial mineral working oil

TABLE 2

| Run No. | Base oil | Additive and the amount of addition (per 100 parts of base oil) | Aging test (min) | Hot test (mA) | Cold test (mA) |
|---|---|---|---|---|---|
| Example | | | | | |
| 1 | 1 | ZnDTP: 0.1 | 4.6 | 50 | 270 |
| 2 | 1 | ZnDTP: 0.2, MoDTC: 0.1 | 3.5 | 50 | 270 |
| 3 | 1 | ZnDTP: 0.2, MoDTP: 0.1 | 4.5 | 50 | 270 |
| 4 | 1 | SP: 2.0 | 3.0 | 50 | 270 |
| 5 | 1 | MoDTC: 0.1 | 5.5 | 50 | 270 |
| 6 | 2 | SP: 2.0 | 3.0 | 50 | 268 |
| 7 | 3 | ZnDTP: 0.2, MoDTC: 0.1 | 4.0 | 300 | 200 |
| 8 | 4 | ZnDTP: 0.2, MoDTC: 0.1 | 5.0 | 200 | 200 |
| Comp. Ex. | | | | | |
| 1 | 1 | — | 6.0 | 110 | 270 |
| 2 | 5 | — | 30.0 | 120 | 260 |

Notes:
ZnDTP, zinc dialkyl dithiphosphate (Lubrizol 1005 of Nippon Lubezol Co., Ltd.)
MoDTC, molybdenum dialkyl dithiocarbamate (Sakura Lube 155, 700 of Asahi Denka Kogyo K.K.)
MoDTP, molybdenum dialkyl dithiophosphate (Sakura Lube 300 of Asahi Denka Kogyo K.K.)
SP, sulfur-phosphorus containing extreme pressure additive (Lubrizol 5034A of Nippon Lubezol Co., Ltd.

Advantages

As will be apparent from the data shown in Table 2, the base oils containing the poly-α-olefin hydride and/or the ethylene-α-olefin copolymer hydride could provide lubricating oils that were satisfactory in various aspects including not only initial "run-in" characteristics, high-temperature life and low-temperature characteristics, but also wear resistance and protection against overcurrent.

Second Embodiment

In accordance with the present invention, polyethylene may further be added to the base oils that contain the poly-α-olefin hydride and/or the ethylene-α-olefin copolymer hydride and which optionally contain a polymethacrylate or polybutene. When the lubricating oils thus prepared were used in a bearing assembly, they would not readily flow out of the assembly, thereby eliminating the problem of oil depletion. This advantageous feature of the invention will now be described with reference to an example. Since the base oils of the lubricating oils have already been described in connection with Example I, the explanation of the portions that overlap with the previous description is omitted from the following discussion, which concerns only the matter that is relevant to the second embodiment.

As described hereinabove, preferred base oils consist either of the poly-α-olefin hydride or the ethylene-α-olefin copolymer hydride or a mixture thereof that have a polymethacrylate or polybutene incorporated therein. It is also stated hereinabove that the polymethacrylate or polybutene, if added at all, may be incorporated in an amount of 5 to 200 parts by weight, preferably 10 to 100 parts by weight, per 100 parts by weight of the poly-α-olefin hydride or the ethylene-α-olefin copolymer hydride or a mixture thereof. In Example II under consideration, the content of the added polymethacrylate or polybutene is 0.1 to 20 parts by weight, preferably 1 to 10 parts by weight.

What is characteristic of the second embodiment is that a polyethylene is further added to the base oils already described above. Exemplary polyethylenes that can be used include low-molecular weight polyethylenes and modified polyethylenes. Preferred polyethylenes are those with molecular weights of 1,000 to 2,500 and melting points of 90 to 110° C. (which hence are solid at room temperature). More preferred polyethylenes are those with attached polar groups, as exemplified by oxygen-containing polyethylenes. The polyethylenes are added in amounts of 0.5 to 10 parts by weight per 100 parts by weight of the base oil.

If the lubricating oil with the polyethylene thusly incorporated in the base oil containing the poly-α-olefin hydride or the ethylene-α-olefin copolymer hydride is impregnated in a sintered porous bearing, the lubricating oil will not readily flow out of the bearing. Therefore, this sintered, oil-filled bearing can advantageously be used as part of the bearing assembly for small motors or the like without experiencing any deterioration in its characteristics such as the passage of an increased amount of current through the motor, increases vibrations of the rotating shaft and increased wow flutters because less of the lubricating oil will flow out of the gap between the shaft and the thrust receptacle and from the gap between the bearing and the mating member.

If necessary, an oxidation inhibitor, a rust or corrosion inhibitor, an antiwear agent, an extreme pressure additive and any other common additives may be incorporated in the lubricating oil for bringing about even better results.

It should be noted here that the lubricating oil of the invention is applicable not only to a motor of the type shown in FIG. 2 which does not use a bearing holder but also to a motor of the type shown in FIG. 1 which has a bearing holder.

Third Embodiment

The second embodiment of the present invention will now be described as it relates mainly to the lubricating oil described above.

A poly-α-olefin hydride (viscosity at 40° C: 16.9 cSt) was prepared by hydrogenating the product of polymerization of 1-decene and 5% of polyethylene wax (oxygen-containing polyethylene available from Mitsui Petrochemical Industries, Ltd. under the trade name "220MP") was incorporated in that polymer hydride to formulate a lubricating oil.

The thus prepared lubricating oil was impregnated in a bearing from a motor of the type shown in FIG. 2 and a test was conducted to evaluate its performance. For comparison, the same poly-α-olefin hydride was tested without incorporating the polyethylene wax.

Figure 5A:
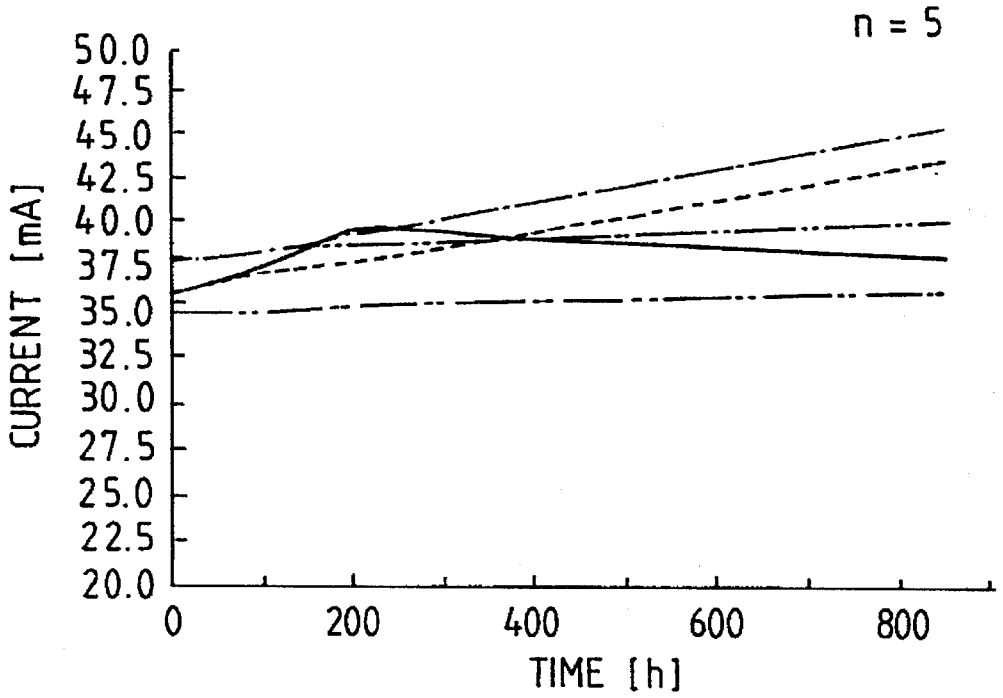
FIG. 5*a* shows the time-dependent change in the current flowing through the motor during non-load operation using the lubricating oil containing no polyethylene.
Figure 5B:
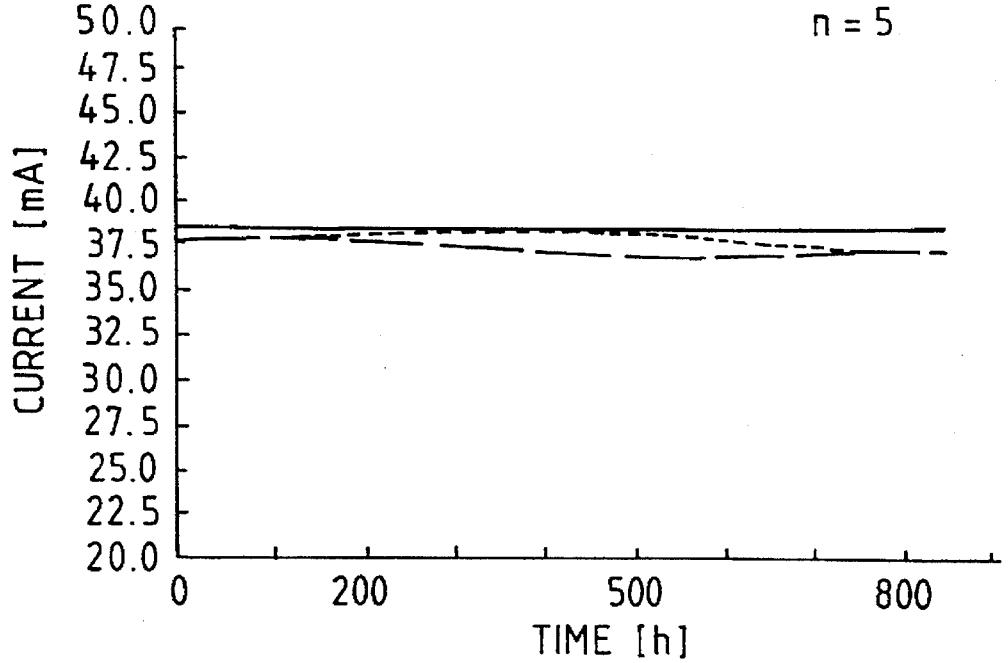
FIG. 5*b* shows the time-dependent change in the current flowing through the motor during non-load operation using the polyethylene-containing lubricating oil.
Figure 5C:
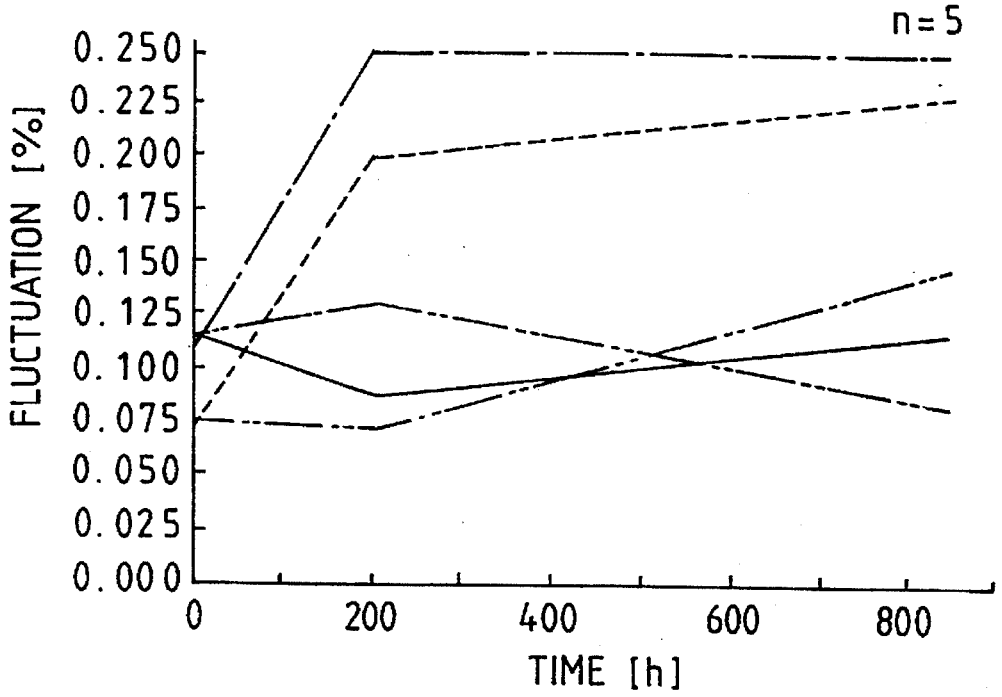
FIG. 5*c* shows the time-dependent change in the fluctuation in the rotational speed of the motor using the lubricating oil containing no polyethylene.
Figure 5D:
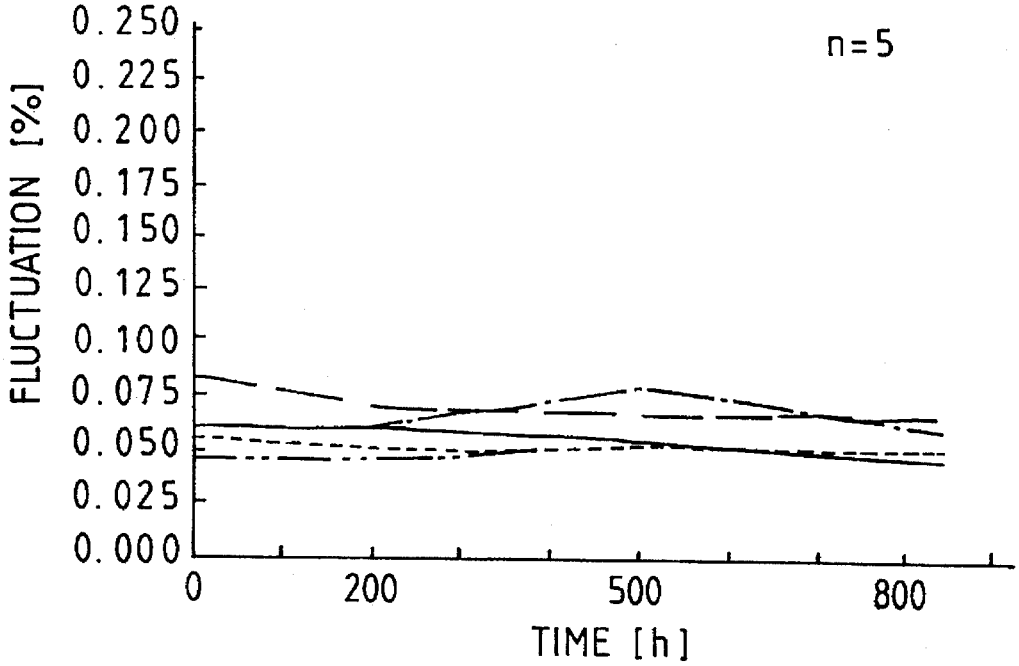
FIG. 5*d* shows the time-dependent change in the fluctuation in the rotational speed of the motor using the polyethylene-containing lubricating oil.

The test results are shown in FIG. 5; the graph in FIG. 5*a* shows the time-dependent change in the current flowing through the motor during non-load operation using the lubricating oil containing no polyethylene; the graph in FIG. 5*b* shows the time-dependent change in the current flowing through the motor during non-load operation using the polyethylene-containing lubricating oil; the graph in FIG. 5*c* shows the time-dependent change in the fluctuation in the rotational speed of the motor using the lubricating oil containing no polyethylene; and the graph in FIG. 5*d* shows the time-dependent change in the fluctuation in the rotational speed of the motor using the polyethylene-containing lubricating oil.

In each test run, five motors were used under the following conditions: 60° C.; 360 rpm; horizontal shaft.

As is clear from FIG. 5, the lubricating oil containing polyethylene exhibited satisfactory performance for a prolonged period in terms of both the current flowing at non-load conditions and uniformity in rotational speed, demonstrating the limited leakage of the lubricating oil.

It should be noted here that the lubricating oil of the invention is applicable not only to a motor of the type shown in FIG. 2 which does not use a bearing holder but also to a motor of the type shown in FIG. 1 which has a bearing holder.

As described on the foregoing pages, the lubricating oil for use with a bearing assembly according to the second aspect of the invention has a polyethylene added in an amount of 0.5 to 10 parts by weight to 100 parts by weight of the base oil containing the poly-α-olefin hydride or the ethylene-α-olefin copolymer hydride. If this lubricating oil is impregnated in a sintered porous bearing, it will not readily flow out of the latter during service and, hence, the bearing can advantageously be applied to small motors of the like with desirable improvement in their characteristics as exemplified by a smaller current flowing through the motor, less vibrations of the rotating shaft and reduced wow flutters.

What is claimed is:

1. A lubricating oil composition for use with sintered porous bearings comprising:

a base oil containing one of a poly-α-olefin hydride and ethylene-α-olefin copolymer hydride polyethylene; and at least one additive selected from the group consisting of zinc dialkyl dithiophosphate, molybdenum dialkyl dithiocarbide, molybdenum dialkyl dithiophosphate and a sulfur-phosphorous containing extreme pressure additive added in an amount of 0.01 to 5 parts by weight per 100 parts by weight of the base oil.

2. A lubricating oil composition according to claim 1 for use with sintered porous bearings wherein the base oil is selected from the group consisting of a poly-α-olefin hydride, an ethylene-α-olefin copolymer hydride and a mixture thereof.

3. A lubricating oil composition according to claim 1 for use with sintered porous bearings wherein the base oil comprises a polymethacrylate or a polybutene and a poly-α-olefin hydride, an ethylene-α-olefin copolymer hydride or a mixture thereof.

4. A lubricating oil for use with bearing assemblies that use a sintered porous bearing comprising:

a base oil containing poly-α-olefin hydride or ethylene-α-olefin copolymer hydride, wherein a polyethylene is added to the base oil in an amount of 0.5 to 10 parts by weight per 100 parts by weight of the base oil.

5. A lubricating oil according to claim 4 for use with bearing assemblies that use a sintered porous bearing, wherein the base oil comprises a poly-α-olefin hydride, an ethylene-α-olefin copolymer hydride or a mixture thereof.

6. A lubricating oil according to claim 4 for use with bearing assemblies that use a sintered porous bearing, wherein the base oil comprises a polymethacrylate or a polybutene and a poly-α-olefin hydride, an ethylene-α-olefin copolymer hydride or a mixture thereof.

7. A lubricating oil according to claim 4 for use with bearing assemblies that use a sintered porous bearing, wherein the base oil comprises a polyethylene having a molecular weight of 1,000 to 2,500 and a melting point of 90° to 110° C.

8. A lubricating oil composition according to claim 1, wherein the base oil comprises a polyethylene having a molecular weight of 1,000 to 2,500.

9. A lubricating oil according to claim 4, wherein the base oil comprises a polyethylene having a molecular weight of 1,000 to 2,500.

10. A sintered porous bearing containing a lubricating oil composition, wherein the lubricating oil composition comprises:

a base oil containing one of a poly-α-olefin hydride and ethylene-α-olefin copolymer hydride;

polyethylene; and at least one additive selected from the group consisting of zinc dialkyl dithiophosphate, molybdenum dialkyl dithiocarbide, molybdenum dialkyldithiophosphate and a sulfur-phosphorous containing extreme pressure additive added in an amount of 0.01 to 5 parts by weight per 100 parts by weight of the base oil.

11. A sintered porous bearing according to claim 10, wherein the base oil is selected from the group consisting of a poly-α-olefin hydride, an ethylene-α-olefin copolymer hydride, and a mixture thereof.

12. A sintered porous bearing according to claim 10, wherein the base oil comprises a polymethacrylate or a polybutene and a poly-α-olefin hydride, an ethylene-α-olefin copolymer hydride or a mixture thereof.

13. A sintered porous bearing according to claim 10, wherein the base oil contains a poly-α-olefinhydride or ethylene-α-olefin copolymer hydride, wherein a polyethylene is added to the base oil in an amount of 0.5 to 10 parts by weight per 100 parts by weight of the base oil.

14. A sintered porous bearing according to claim 13, wherein the base oil comprises a poly-α-olefin hydride, an ethylene-α-olefin copolymer hydride or a mixture thereof.

15. A sintered porous bearing according to claim 13, wherein the base oil comprises a polymethacrylate or a polybutene and a poly-α-olefin hydride, an ethylene-α-olefin copolymer hydride or a mixture thereof.

16. A sintered porous bearing according to claim 13, wherein the base oil comprises a polyethylene having a molecular weight of 1,000 to 2,500 and a melting point of 90° to 110° C.

17. A sintered porous bearing according to claim 10, wherein the base oil comprises a polyethylene having a molecular weight of 1,000 to 2,500.

18. A sintered porous bearing according to claim 13, wherein the base oil comprises a polyethylene having a molecular weight of 1,000 to 2,500.

* * * * *